US008430259B2

(12) United States Patent
Martinez et al.

(10) Patent No.: US 8,430,259 B2
(45) Date of Patent: Apr. 30, 2013

(54) CLOSURE WITH FLEXIBLE DIAPHRAGM

(75) Inventors: Ray Martinez, Barrington, IL (US); Neil Enciso, Barrington, IL (US)

(73) Assignee: Stokely-Van Camp, Inc., Chicago, IL (US)

( * ) Notice: Subject to any disclaimer, the term of this patent is extended or adjusted under 35 U.S.C. 154(b) by 979 days.

(21) Appl. No.: 12/062,829

(22) Filed: Apr. 4, 2008

(65) Prior Publication Data

US 2009/0250465 A1 Oct. 8, 2009

(51) Int. Cl.
*B65D 51/16* (2006.01)

(52) U.S. Cl.
USPC ..... 220/203.11; 220/203.17; 220/288; 220/367.1; 220/378; 215/11.4; 215/260; 222/562; 222/568

(58) Field of Classification Search ..... 220/203.11, 220/288, 378, 203.17, 367.1; 215/11.4, 260; 222/562, 568
See application file for complete search history.

(56) References Cited

U.S. PATENT DOCUMENTS

| | | | | |
|---|---|---|---|---|
| 400,434 | A | | 4/1889 | Bunnell |
| 2,894,524 | A | | 7/1959 | Gill |
| 3,141,586 | A | | 7/1964 | Wetterek |
| 3,245,569 | A | | 4/1966 | Essich |
| 3,406,862 | A | | 10/1968 | Donaldson |
| 3,595,429 | A | | 7/1971 | Kohen |
| 3,684,119 | A | | 8/1972 | Burroughs |
| 4,036,386 | A | | 7/1977 | Nishioka et al. |
| 4,057,168 | A | | 11/1977 | Bosshold |
| 4,440,308 | A | | 4/1984 | Baker |
| 4,645,096 | A | | 2/1987 | Grant |
| 4,653,661 | A | | 3/1987 | Buchner et al. |
| 4,671,421 | A | | 6/1987 | Reiber et al. |
| 4,823,969 | A | | 4/1989 | Caldwell |
| 4,892,126 | A | | 1/1990 | Bucheler et al. |
| 4,896,789 | A | * | 1/1990 | Federspiel ..... 220/203.17 |
| 4,917,269 | A | | 4/1990 | Fuchs et al. |
| 4,956,156 | A | | 9/1990 | Kanner et al. |
| 4,982,855 | A | | 1/1991 | Hertrampf |
| 4,991,732 | A | | 2/1991 | La Barge et al. |
| 4,993,572 | A | | 2/1991 | Ochs |
| 5,005,717 | A | | 4/1991 | Oilar |
| 5,020,692 | A | | 6/1991 | Darr |
| 5,060,827 | A | | 10/1991 | Segati |
| 5,071,017 | A | | 12/1991 | Stull |
| 5,075,951 | A | | 12/1991 | Schurr et al. |
| 5,117,999 | A | | 6/1992 | Canzano et al. |
| 5,207,341 | A | | 5/1993 | Yeager |
| 5,207,356 | A | | 5/1993 | Krall |
| 5,232,113 | A | | 8/1993 | Chen-Tsai et al. |
| 5,356,030 | A | | 10/1994 | Budenbender |
| 5,390,805 | A | * | 2/1995 | Bilani et al. ..... 215/260 |

(Continued)

*Primary Examiner* — Anthony Stashick
*Assistant Examiner* — Elizabeth Volz
(74) *Attorney, Agent, or Firm* — Banner & Witcoff, Ltd.

(57) ABSTRACT

A closure with a flexible diaphragm that equalizes the internal pressure of a container to the external pressure. The closure may include an inner member having a generally cylindrical wall. The cylindrical wall may include internal threads capable of engaging with external threads of the container. The closure may also include an outer member including a generally circular cap body and an annular ring extending downward from the edges of the cap body. The annular ring shrouds at least a portion of the cylindrical wall. A flexible diaphragm may be operatively attached to the top of the cylindrical wall and spaced apart from the cap body. The flexible diaphragm deflects in response to the internal pressure of the container.

17 Claims, 1 Drawing Sheet

U.S. PATENT DOCUMENTS

| | | | |
|---|---|---|---|
| 5,407,087 | A | 4/1995 | Giblin et al. |
| 5,437,387 | A | 8/1995 | Burns |
| 5,454,489 | A | 10/1995 | Vesborg |
| 5,499,729 | A | 3/1996 | Greenwood et al. |
| 5,577,625 | A | 11/1996 | Baird et al. |
| 5,597,090 | A | 1/1997 | Leahy |
| 5,641,085 | A | 6/1997 | Lonbardo |
| 5,678,719 | A | 10/1997 | Adams et al. |
| 5,688,544 | A | 11/1997 | Bolton et al. |
| 5,709,313 | A | 1/1998 | Richoux et al. |
| 5,819,976 | A | 10/1998 | Boehm et al. |
| 5,908,129 | A | 6/1999 | Schutz |
| 5,909,820 | A | 6/1999 | Yeh |
| 5,957,317 | A | 9/1999 | Lee |
| 5,971,189 | A | 10/1999 | Baughman |
| 6,102,225 | A | 8/2000 | Lynn |
| 6,216,897 | B1 | 4/2001 | Wagner |
| 6,269,968 | B1 | 8/2001 | Belcastro |
| 6,321,931 | B1 | 11/2001 | Hakim et al. |
| 6,398,050 | B1 | 6/2002 | Allora |
| 6,500,380 | B1 | 12/2002 | Geisinger |
| 6,543,207 | B2 | 4/2003 | Mainquist et al. |
| 6,672,817 | B2 | 1/2004 | Denny |
| 6,983,857 | B2 | 1/2006 | Miller et al. |
| 7,032,768 | B2 | 4/2006 | Felbaum |
| 7,048,136 | B2 | 5/2006 | Havens et al. |
| 7,131,550 | B2 | 11/2006 | Vilalta et al. |
| 7,198,169 | B2 | 4/2007 | Silk |
| 7,287,662 | B2 | 10/2007 | Van De Klippe et al. |
| 7,329,041 | B2 | 2/2008 | Nottingham et al. |
| 2002/0011498 | A1 | 1/2002 | Giblin et al. |
| 2003/0183631 | A1 | 10/2003 | Cross et al. |
| 2004/0124192 | A1 | 7/2004 | Teller |
| 2005/0211661 | A1 | 9/2005 | Galownia et al. |
| 2005/0247661 | A1 | 11/2005 | Robertson |
| 2006/0151422 | A1 | 7/2006 | Manley |
| 2007/0051723 | A1 | 3/2007 | Naesje |
| 2007/0051727 | A1 | 3/2007 | Holley, Jr. |
| 2008/0017642 | A1 | 1/2008 | King |

* cited by examiner

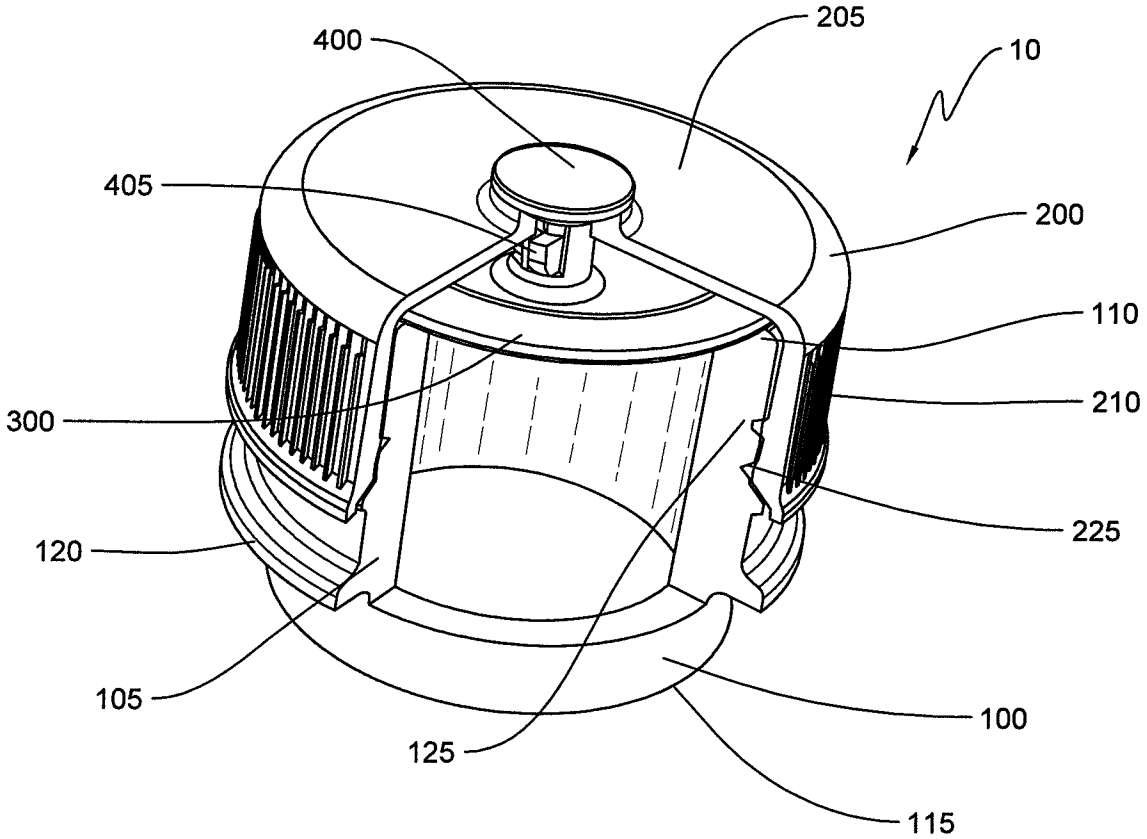
10
205
400
405
200
110
210
225
300
120
105
125
100
115

CLOSURE WITH FLEXIBLE DIAPHRAGM

FIELD OF THE INVENTION

This invention relates generally to closures or stoppers for containers, and more specifically to closures for beverage containers.

BACKGROUND

Many types of container closures exist for glass and plastic bottles. One type of bottle closure is a metal cap, which is crimped onto the top of a glass bottle and requires a bottle opener to remove it. Another type of bottle closure is a cap that screws onto the neck of a bottle. These caps include internal threads that mate with external threads on the neck of the bottle. Generally, these bottle caps seal the opening of a bottle by coming into contact with the top of the bottle neck and covering the opening of the bottle. It is known that some bottle closures include a spout containing an orifice for dispensing liquid. The spout may be pulled away from the closure to open the orifice, or the spout may be rotated upwards to open the orifice.

It is further known that some container closures are designed to vent the container and equalize the pressure of the container relative to the external pressure. However, known drawbacks exist with these closures. For instance, these closures sometimes do not provide a continuous seal because they include an opening that not only allows air or gas to escape but some liquid as well. Additionally, the known closures sometimes include or develop a weak zone, which fails when a pressure limit is exceeded, thereby rendering the closure ineffective. These and other known drawbacks are overcome by the present invention.

SUMMARY OF THE INVENTION

The present invention is directed to a container and closure assembly that equalizes internal pressure of a container relative to the outside pressure. The container and closure assembly includes an inner member that is formed as part of the neck of the container, an outer member that is formed as part of the closure, and a flexible diaphragm positioned between the inner and outer members. The inner member defines a generally annular wall having a top, a bottom, and threads capable of engaging with threads on the outer member. The outer member defines a generally circular cap body having an annular wall extending downward shrouding at least a portion of the annular wall of the inner member. The flexible diaphragm may be operatively attached to the top of the annular wall of the inner member, and spaced apart from the cap body.

In operation, the flexible diaphragm deflects toward the cap body when the pressure in the container increases. Conversely, the flexible diaphragm deflects toward the container when the pressure in the container decreases. These deflections allow the pressure in the container to equalize to the outside pressure without deforming the bottle. The closure of the invention, therefore, equalizes pressure that builds up in a container, while providing a leak-resistant seal.

One advantage of the closure of the invention is that the closure may allow for efficient use of material, driving down manufacturing costs. Additionally, the closure may allow for light weight finishes and efficient use of finish material.

Other features and advantages of the invention will become apparent to those skilled in the art upon review of the following detailed description, claims and drawings in which like numerals are used to designate like features.

BRIEF DESCRIPTION OF THE DRAWINGS

FIG. 1 is an isometric cross-sectional view of the container and closure assembly illustrating an exemplary internal diaphragm.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION

The invention may be embodied in many forms. FIG. 1 illustrates a partial view of a container, such as a bottle, and depicts an exemplary closure 10 that may be used to equalize the internal pressure of the container relative to the external pressure of the container. The closure and container assembly depicted in FIG. 1 may include an inner member 100 formed as part of the container and more specifically formed as part of the neck of the container. The inner member 100 may define an annular or cylindrical wall 105 having a top 110 and a bottom 115. The annular wall 105 may include one or more threads capable of engaging with threads of the closure. In one embodiment, the annular wall 105 may further define a flange or ring 120 near the bottom 115.

In the exemplary embodiment, the container and closure assembly may include an outer member 200 formed as part of the closure 10. The outer member 200 may include a cap body 205 with an annular ring 210 extending downward from the edges of the cap body 205. The annular ring 210 may be used to shroud at least a portion of the annular wall 105. In one embodiment, the annular ring 210 shrouds the entire annular wall 105. In an alternative embodiment, the annular ring 210 shrouds a portion of the annular wall 105 above the flange 120.

In at least one embodiment, the annular wall 105 may include one or more external threads 125 and the annular ring 210 of the closure 10 may include internal threads 225. The external threads 125 and internal threads 225 are configured to mate with each other and provide a seal between the internal member 100 and the external member 200 and consequently a seal between the container and the closure. In an alternative embodiment, the annular wall 105 and the annular ring 210 may create a seal by abutting each other.

As depicted by FIG. 1, the outer surface of the annular ring 210 may include a plurality of ridges or gripping elements for gripping the closure 10 to assist in rotating the closure from an open position to a closed position, and vice versa. It should be understand that other gripping element configurations and techniques for assisting the opening of the closure are possible with the invention.

In an exemplary aspect of the invention, the closure 10 may include a flexible diaphragm 300. The flexible diaphragm 300 may be generally circular and may be operatively attached to the cap body 205. The flexible diaphragm 300 may be spaced from the inner surface of the cap body 205. The diaphragm 300 may define the depicted circular shape or may define other shapes and configurations depending on the shape of the container. In use, once the closure 10 is threaded on to the container, the diaphragm will contact the top 110 of the annular wall 105 and create a leak-resistant seal with the inner member 100 and thus the container, preventing liquid from the container from exiting the container when the closure 10 is in the closed position, and preventing outside contaminants from entering the container.

In operation, the flexible diaphragm 300, which may be made of any suitable material, such as rubber, deflects in response to pressure in the container to equalize the pressure in a container relative to the outside pressure, or otherwise stabilize the internal pressure. For example, the flexible diaphragm 300 may deflect upwards towards the cap body 205 in response to an increase in pressure in the container to thereby accommodate the increase in volume in the container as a result of the increase in pressure. Conversely, the flexible diaphragm 300 deflects towards the interior of the container when there is a decrease in pressure in the container to accommodate or otherwise take up the decrease in volume in the container. The closure 10 and diaphragm 300, therefore, compensates for any increase or decrease in pressure and resultant change in volume within the container, and also prevents the change in internal container pressure from exerting undesirable stresses on the container wall.

In one embodiment, the closure 10 may include a connecting member 400 which connects or joins the flexible diaphragm 300 and the cap body 205. The connecting member 400 may also aid in permitting movement of the diaphragm when there is a change in internal pressure within the container. The connecting member 400 may be positioned near the center of the cap body 205 and flexible diaphragm 300, and may also include a protrusion 405 or a plurality of protrusions aiding in the separation of the flexible diaphragm 300 and the cap body 205. In other words, the protrusions 405 may be used to maintain separation between the interior surface of cap body 205 and the diaphragm 300.

It should be understood that the closure 10 may be made of any suitable material, such as plastic. The inclusion of the flexible diaphragm 300 may allow for lighter materials to be used for the closure 10 and a corresponding container because the flexible diaphragm 300 responds to internal pressure to relieve the pressure and resultant stress on the closure 10 and container. The closure and container assembly of the invention, therefore, may result in material and cost savings in the manufacturing of beverage containers and closures.

Variations and modifications of the foregoing are within the scope of the present invention. For example, in an alternative embodiment, the closure 10 may include a tamper-evident ring operatively attached to a bottom of the annular ring 210 of the closure. It should be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A container closure assembly comprising:

an inside member formed on a container and having a generally cylindrical wall, the cylindrical wall defining a thread, the cylindrical wall further including a top and a bottom;

an outside member including a generally circular cap body and an annular ring extending outward from the cap body and over the top of the cylindrical wall, the annular ring shrouding at least a portion of the cylindrical wall, the annular ring defining a thread for engaging the thread on the cylindrical wall; and a flexible diaphragm operatively attached to and spaced apart from the cap body;

a connecting member defining a plurality of protrusions, wherein each of the plurality of protrusions are connected to the center of the cap body and connected to the center of the flexible diaphragm and extend between the cap body and the flexible diaphragm, and wherein the connecting member separates the cap body and the flexible diaphragm, wherein the flexible diaphragm deflects in response to a change in pressure within the container, and wherein the flexible diaphragm is configured to contact the top of the cylindrical wall to create a leak resistant seal.

2. The assembly of claim 1, wherein the diaphragm deflects towards the cap body in response to an increase in pressure within the container.

3. The assembly of claim 1, wherein the diaphragm deflects towards the container in response to a decrease in pressure within the container.

4. The assembly of claim 1, wherein the diaphragm is made of rubber.

5. The assembly of claim 1, wherein rotating the annular ring opens and closes the closure.

6. The assembly of claim 1, wherein the annular ring shrouds the entire cylindrical wall.

7. A container closure assembly comprising:

an inside member formed on a container and having a generally cylindrical wall, the cylindrical wall including a thread, the cylindrical wall further including a top and a bottom;

an outside member including a generally circular cap body and an annular ring extending outward from the cap body over the top of the cylindrical wall, the annular ring shrouding at least a portion of the cylindrical wall;

a flexible diaphragm operatively attached to and spaced apart from the cap body; and a connecting member defining a plurality of protrusions, wherein each of the plurality of protrusions are connected to the center of the cap body and connected to the center of the flexible diaphragm and extend between the cap body and the flexible diaphragm, and wherein the connecting member separates the flexible diaphragm from the cap body;

wherein the flexible diaphragm deflects in response to a change in pressure within the container, and wherein the flexible diaphragm is configured to contact the top of the cylindrical wall to create a leak resistant seal.

8. The assembly of claim 7, wherein the diaphragm deflects towards the container in response to a decrease in pressure within the container.

9. The assembly of claim 7, wherein the diaphragm deflects towards the cap body in response to an increase in pressure within the container.

10. The assembly of claim 7, wherein the annular ring includes internal threads and the cylindrical wall includes external threads that create a leak-resistant seal when engaged with each other.

11. The assembly of claim 7, wherein rotating the annular ring opens and closes the closure.

12. The assembly of claim 7, wherein the annular ring shrouds the entire cylindrical wall.

13. A container and closure assembly comprising:

an inside member formed on a container and having a generally cylindrical wall, the cylindrical wall further including a top and a bottom and a flange near the bottom;

an outside member including a generally circular cap body, the outside member further including an annular ring extending downward from the cap body over the top of the cylindrical wall and shrouding a portion of the cylindrical wall above the flange;

a flexible diaphragm operatively attached to and spaced apart from the cap body; and a connecting member defining a plurality of protrusions, wherein each of the plurality of protrusions are connected to the center of the cap body and connected to the center of the flexible diaphragm and extend between the flexible diaphragm and cap body, and wherein the plurality of protrusions separate the flexible diaphragm from the cap body;

wherein the flexible diaphragm deflects in response to a change in pressure within the container, and wherein the flexible diaphragm is configured to contact the top of the cylindrical wall to create a leak resistant seal.

14. The assembly of claim 13, wherein the diaphragm deflects towards the container in response to a decrease in pressure within the container.

15. The assembly of claim 13, wherein the diaphragm deflects towards the cap body in response to an increase in pressure within the container.

16. The assembly of claim 13, wherein the annular ring includes internal threads and the cylindrical wall includes external threads that create a leak-resistant seal when engaged with each other.

17. The assembly of claim 13, wherein rotating the annular ring opens and closes the closure.

* * * * *